US005507915A

United States Patent [19]

Durkin et al.

[11] Patent Number: 5,507,915

[45] Date of Patent: Apr. 16, 1996

[54] MULTI-LAYERED PAPERMAKERS FABRIC FOR THRU-DRYER APPLICATION

[75] Inventors: Thomas B. Durkin, Depere; Frank Biasone, Appleton, both of Wis.

[73] Assignee: Asten, Inc., Charleston, S.C.

[21] Appl. No.: 950,413

[22] Filed: Sep. 23, 1992

Related U.S. Application Data

[63] Continuation of Ser. No. 591,723, Oct. 2, 1990, Pat. No. 5,151,316, which is a continuation of Ser. No. 445,547, Dec. 4, 1989, Pat. No. 5,013,330.

[51] Int. Cl.[6] ..... D21F 7/12

[52] U.S. Cl. ..... 162/117; 162/902; 162/116

[58] Field of Search ..... 162/902, 109, 162/232, 900, 116, 903, 117; 428/212, 213, 116, 212, 224, 225, 247, 257, 153; 139/383 A

[56] References Cited

U.S. PATENT DOCUMENTS

| | | | |
|---|---|---|---|
| 3,322,617 | 5/1967 | Osborne | 162/296 |
| 3,885,602 | 5/1975 | Slaughter | 162/903 |
| 3,885,603 | 5/1975 | Slaughter | 139/425 A |
| 4,503,113 | 3/1985 | Smart | 428/234 |
| 4,515,853 | 5/1985 | Borel | 428/257 |
| 4,528,239 | 7/1985 | Trokhan | 428/247 |
| 4,759,391 | 7/1988 | Waldvogel et al. | 139/383 A |
| 4,813,156 | 3/1989 | Ashworth et al. | 34/116 |
| 5,098,519 | 3/1992 | Ramasobramanian | 162/109 |

FOREIGN PATENT DOCUMENTS

| | | |
|---|---|---|
| 426288 | 5/1991 | European Pat. Off. . |
| 69101 | 1/1993 | European Pat. Off. . |
| 2122596 | 9/1972 | France . |
| 3224236 | 3/1984 | Germany . |
| 232715 | 1/1987 | Germany . |
| 1063672 | 3/1967 | United Kingdom . |

*Primary Examiner*—Brenda A. Lamb
*Attorney, Agent, or Firm*—Volpe and Koenig

[57] ABSTRACT

A multi-layer fabric for carrying and forming an embossed paper web is provided which comprises two separate woven fabric layers which are joined together, preferably during weaving. The top fabric layer is a very coarse mesh open fabric which supports the web and assists in forming the embossed characteristic of the web. The top layer is connected to a base fabric layer which is a substantially finer mesh. The layers are preferably interconnected by binder strands which interweave as structural warps or shutes of the finer mesh fabric layer.

2 Claims, 2 Drawing Sheets

MULTI-LAYERED PAPERMAKERS FABRIC FOR THRU-DRYER APPLICATION

This is a continuation of now U.S. Pat. No. 5,151,316 for MULTI-LAYERED PAPERMAKERS FABRIC FOR THRU-DRYER APPLICATION, which was continuation of application Ser. No. 07/445,547, filed Dec. 4, 1989, now U.S. Pat. No. 5,013,330 for MULTI-LAYERED FABRIC FOR THRU-DRYER APPLICATION.

The present invention relates to papermakers fabrics, and, in particular, fabrics intended for use in thru-dryer applications in connection with formation of nonwoven paper products. The nonwoven paper products are intended to have the softness and feel associated with cloth products but have improved strength in comparison with similar nonwoven products. In general, products produced with fabrics in accordance with the invention may be classified as embossed nonwoven paper products.

BACKGROUND OF THE INVENTION

In the typical process for producing embossed-nonwoven paper products, the papermaking equipment has a formation area, a thru-drying area and a final drying area. Such a process is described in U.S. Pat. No. 4,528,239 which is incorporated herein by reference as if fully set forth. In the forming area, an initial embryonic web is formed on a formation fabric and is transferred to a second formation fabric which subsequently rearranges and further dewaters the web. The present invention or thru-dryer fabric is concerned with the second formation position.

U.S. Pat. No. 3,322,617 discloses the use of two formation fabrics in the forming position for the purpose of producing simulated grain on a nonwoven product. The upper or primary formation fabric is of a large open area with a very coarse weave and the second, fiber retention fabric is of a much finer weave. The fabrics run simultaneously but are not interconnected.

U. S. Pat. No. 3,885,603 discloses a formation fabric having a fine upper fabric and a coarse lower fabric which are interconnected by binder yarns. This dual layer fabric is used as a formation belt with the fine ply operating in contact with the paper web. As a result of the binder yarns, the two fabrics operate as one unit. U.S. Pat. No. 4,515,853 discloses a similar use of binder yarns.

OBJECTS AND SUMMARY OF THE INVENTION

The present invention relates to a fabric for use in a secondary formation process. Accordingly, the papermaking equipment is operated to pre-form the paper forming material into an aqueous web or an initial web on a generally planar fabric, to transfer or transport the web and introduce the web onto a thru-dryer fabric of the present invention and to cause the web to be deformed by the movement of the fibers of the web into depressions or dimples of the thru-dryer fabric.

It is an object of the present invention to create a pillow effect on the wet-laid web to improve bulk, softness, and flexibility while at the same time allowing up to 40% reduction in basis weight over conventional fabrics. It is also an object of the invention to provide a relatively large cross machine direction to a machine direction stretch ratio which improves the total tensile strength.

Further objects of the invention are to simplify the manufacturing of the thru-air drying fabric, provide substantially longer fabric service life, and improve the ability to clean the fabric in use.

A multilayer fabric is provided which comprises two separate fabric layers which are joined together, preferably during weaving. The top fabric layer is a very coarse mesh open fabric which supports the web and assists in forming the embossed characteristic of the web. The top layer is connected to a base fabric layer which is a substantially finer mesh. The layers are preferably interconnected by binder strands which interweave as structural warps or shutes of the finer mesh fabric layer.

The coarse mesh top layer may be woven in a 2-shed, 3-shed, 4-shed or even higher harness construction, either in twill or a broken weave constructions. The base fabric is preferably woven in a plain weave, but also may be woven in a 3, 4 or 5-shed construction. Preferably, the top fabric layer is a 5-shed which is most advantageous for the pillow areas and the base fabric is preferably a plain weave to provide maximum stability for the upper layer.

The fine mesh bottom layer in a plain weave offers substantial support to the coarse mesh upper layer. All material, both warp and shute, in addition to the binder, are preferably, hydrolysis resistant material to improve service life.

Further objects and advantages are apparent from the following description of a presently preferred embodiment.

DETAILED DESCRIPTION OF PREFERRED EMBODIMENT

Figure 1:
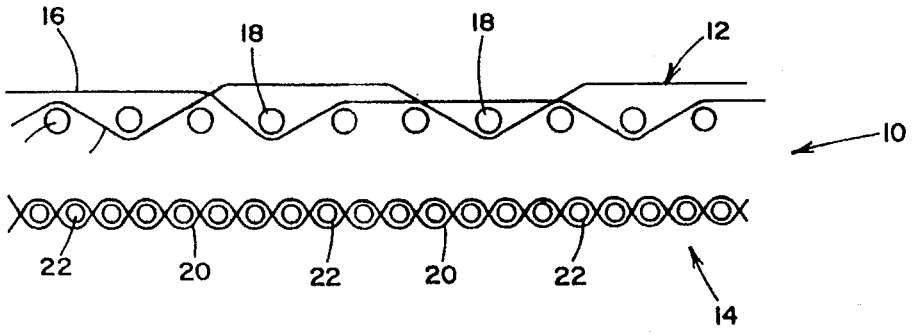
FIG. 1 is a schematic diagram of a partial cross section in the machine direction of a multi-layer fabric made in accordance with the teachings of the present invention.
Figure 2:
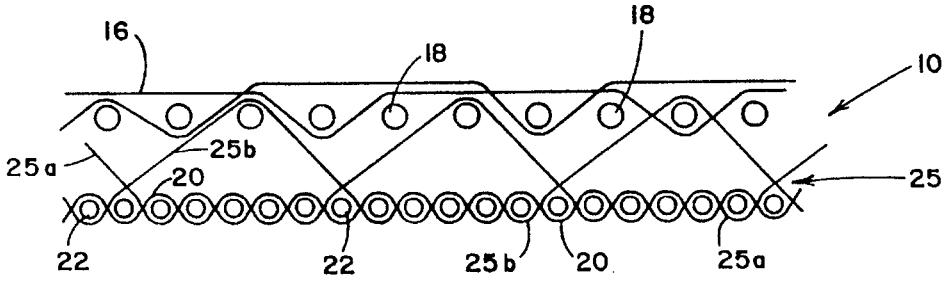
FIG. 2 is a cross section of the fabric depicted in FIG. 1 along the binding yarns which interweave the fabric layers.
Figure 3:
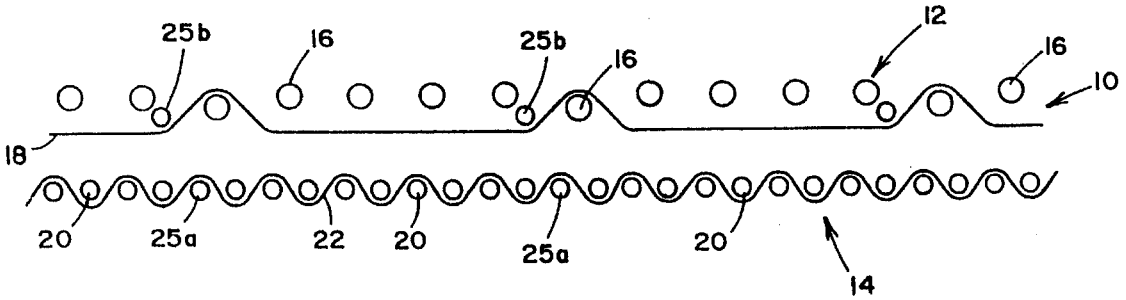
FIG. 3 is a schematic cross section of the fabric depicted in FIGS. 1 and 2 in the cross machine direction.
Figure 4:
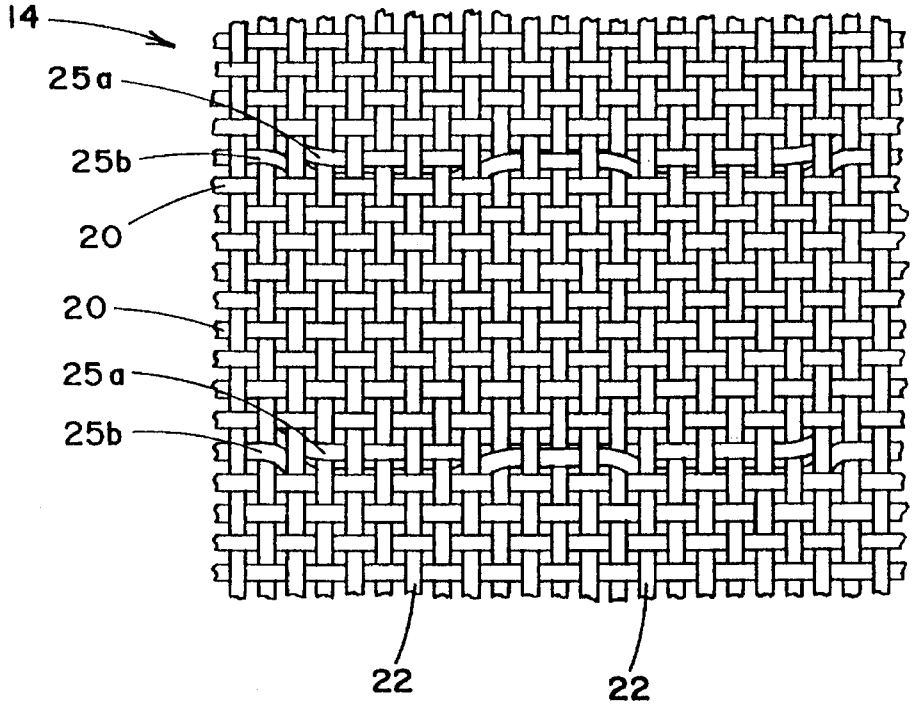
FIG. 4 is a top plan view of the fabric depicted in FIG. 1.

Referring to FIGS. 1 and 2, a multi-layer fabric 10 according to the present invention is shown having an upper layer 12 and base layer 14. Yarns 16 and 18 are interwoven to produce a coarse upper fabric layer 12, and yarns 20 and 22 are interwoven to produce a finer bottom fabric layer 14. The two layers 12, 14 are connected by binder yarns 25. The layers are woven simultaneously with the binder strands which hold the two fabrics together. Preferably, yarns 16, 20, 25 are strung as warp on the loom and yarns 18, 22 are interwoven therewith.

In the preferred embodiment the weave construction of the top coarser fabric is a 5-shed broken weave and the lower fabric is a plain weave. The 5-shed top layer is approximately 35 by 32 yarns per inch and can be as low as 14 by 12 yarns per inch. The plain weave bottom is approximately 70 by 64 yarns per inch and which can be as low as 28 by 24 yarns per inch. Preferably, the yarns of the top layer are between 0.010 and 0.025 inches in diameter, and the base layer and binder yarn are smaller in diameter being between 0.005 and 0.017 inches. The mesh counts and yarn size in both the top and bottom fabrics can be varied in accordance with the above parameters and in view of the end product desired. Preferably the ratio of yarn count between the bottom and top layers is at least 2:1 and the size ratio is between 3:1 and 5:4.

With reference to FIGS. 2–5, the binder yarns 25 interweave in pairs 25*a*, 25*b* with the top and bottom layers 12, 14. Each pair of binder yarns interweaves at a single warp location within the bottom fabric layer weave structure. For example, binder yarn 25*a* interweaves with five bottom layer yarns 22 then passes over seven bottom layer yarns while it interweaves with the top layer 12 before it returns to interweave with five more bottom layer yarns. Binder yarn 25*b* interweaves with five of the seven bottom layer yarns over which binder yarn 25*a* passes. When binder yarn 25*b* interweaves with the top layer 12, binder yarn 25*b* passes over seven bottom layer yarns which seven yarns include the five yarns with which binder yarn 25*a* interweaves.

The binder yarns are preferably the same size as the bottom layer warp yarns. Accordingly, they blend into the weave of the bottom layer 14 and form a structural part of that layer. Although the binder yarns occupy discernibly more space than a single warp yarn 20 within the bottom layer 14, they occupy significantly less than the space occupied by two adjacent warp yarns 22 in the bottom layer 14. Thus the binding yarns do not have any substantial effect on the permeability and open area of the bottom layer.

Figure 5:
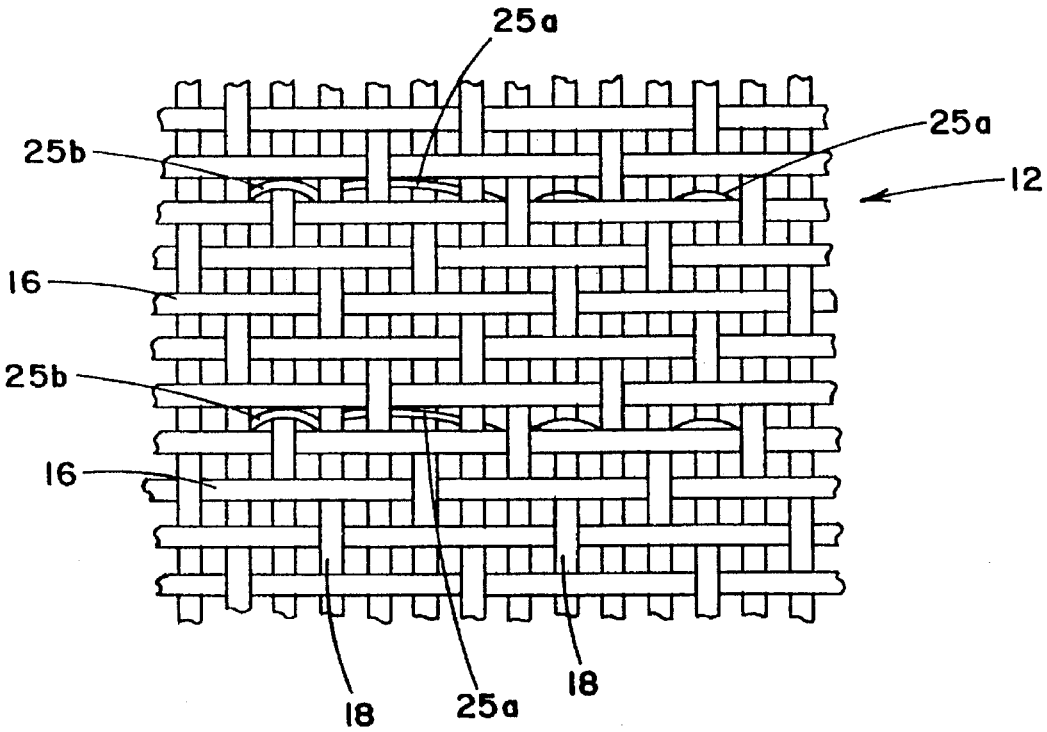
FIG. 5 is a bottom plan view of the fabric depicted in FIG. 1.

As best seen in FIGS. 2 and 5, the binder yarn pairs 25*a*, 25*b* preferably interweave with every third top layer yarn 18. In practice, the binder yarns 25*a*, 25*b* tend to weave along side warp yarns 16 when weaving over shute yarns 18, in lieu of weaving substantially in the middle between adjacent warp yarns 16. Due to the smaller size of the binder yarns and their tendencies in weaving, the open area and uniformity of surface and formation characteristics of the upper layer are substantially unaffected by the binder yarns.

The use of a higher mesh count in the lower or bottom fabric prevents the fibers of the aqueous paper web from blowing through the fabric during the thru-dryer processing. The use of a coarser fabric having a lower mesh count in the upper or top layer permits formation of pillows or a textured surface on the web in the thru-dryer position. The binding yarns 25 lock the fabric layers 12, 14 to each other to avoid irregularities which may result from shifting of the fabric layers relative to each other. In addition the use of binder strands results in a bottom fabric layer which is a carrier for the forming ply.

Example 1. The fabric is woven from monofilament, hydrolysis resistant, polyester yams. A top fabric layer is woven 14 warp by 12 shute yarns per inch. The weave pattern is a 5-shed broken weave with a warp of 0.020 inches and a shute of 0.020 inches. Accordingly, the top layer hole size is 0.0633 inches by 0.0514 inches with a hole diagonal of 0.0816 inches, open area 54.7%, air permeability 1085 CFM (per square foot at ½ inch pressure drop), and caliper 0.069 inches. The bottom fabric layer is woven 28 warp by 24 shute yarns per inch having warp yarns of 0.0158 inches and shute yarns of 0.0158 inches in a plain weave. The hole size in the bottom fabric is approximately 0.0259 inches by 0.0199 inches with a hole diagonal of 0.0326 inches, open area 31.7%, and air permeability 700 CFM. The binder pairs define every tenth warp on the bottom layer and-are disposed after every fifth warp layer of the top layer binding every third top shute as shown in FIGS. 2–5.

Example 2. A top fabric layer is woven 35 warp by 32 shute yarns per inch. The weave pattern is a 5-shed broken weave with a warp of 0.0158 inches and a shute of 0.0158 inches. Accordingly, the top layer hole Size is 0.0155 inches by 0.0128 inches with a hole diagonal of 0.020 inches, open area 22.1%, and air permeability 800 CFM. The bottom fabric layer is woven 70 warp by 64 shute yarns per inch having warp yarns of 0.0067 inches and shute yarns of 0.0067 inches in a plain weave. The hole size in the bottom fabric is approximately 0.0089 inches by 0.0076 inches with a hole diagonal of 0.0117 inches, open area 30.3%, and air permeability 650 CFM. The binder pairs define every tenth warp on the bottom layer and are disposed after every fifth warp layer of the top layer binding every third top shute as shown in FIGS. 2–5.

In both examples, the fabrics provide a uniform pattern of depressions or dimples with the lower fabric helping to increase the density of the paper web in the dimple area while its density is dramatically reduced on the top surface. The multilayer thru-dryer fabric may be surfaced by abrading the top layer yarns to provide from 15% to as high as 40% contact area. The contact area assists in the moving the fiber into the dimpled areas for basis weight reduction. In addition, through heatsetting processes, the ratio of warp shuts contact areas may be varied in order to have a direct effect on the tensile strength of the sheet.

The present thru-dryer fabric avoids the costly prior art techniques of creating an embossing layer on a substrate while producing a machine applications and the necessary paper contact characteristics to produce the desired non-woven product.

What is claimed is:

1. A method of using a papermaker's fabric to produce a paper product with a textured surface and improved bulk comprising:

providing a unitary woven fabric having a first woven layer defining a first fabric surface, a second woven layer defining a second fabric surface, the second layer being woven in a substantially coarser mesh than the first layer from yarns and having a significantly larger size than the first layer yarns, and means for interconnecting the first and second layers such that the interconnection of the first layer with the second layer provides structural support and stability to the second layer; and using the fabric to make the paper product wherein the fabric is installed in a secondary forming thru-dryer position on papermaking equipment such that the first fabric layer is in direct contact with the papermaking equipment and an aqueous web comes in contact with the second fabric layer while the fabric aids in transporting and forming of the web into the paper product and the papermaking equipment is operated to pre-form the paper forming material into the aqueous web, to introduce the aqueous web onto the fabric and to cause the aqueous web to be deformed to create a pillow effect on the aqueous web while being transported by the fabric.

2. A method of using a papermaker's fabric to produce an embossed, non-woven paper product comprising:

providing a unitary woven fabric having a first woven layer defining a first fabric surface, a second woven layer defining a second fabric surface, the second layer being woven in a substantially coarser mesh than the first layer from yarns and having a significantly larger size than the first layer yarns, and means for interconnecting the first and second layers such that the interconnection of the first layer with the second layer provides structural support and stability to the second layer; and using the fabric to make the non-woven paper product by installing the fabric in a thru-drying position on papermaking equipment such that the first fabric layer is in direct contact with the papermaking equipment and an aqueous web comes in contact with the second fabric layer while the fabric aids in transporting and forming of the web into the non-woven paper product and the papermaking equipment is operated to pre-form paper forming material into the web, to introduce the web onto the fabric and to cause the web to be deformed, whereby fibers of the web are moved into the coarser mesh of the second fabric layer during thru-drying resulting in embossment of the non-woven paper product being produced.

* * * * *

UNITED STATES PATENT AND TRADEMARK OFFICE

CERTIFICATE OF CORRECTION

PATENT NO. : 5,507,915

DATED : April 16, 1996

INVENTOR(S) : Thomas B. Durkin et al.

It is certified that error appears in the above-identified patent and that said Letters Patent is hereby corrected as shown below:

At column 1, line 22, delete "embossed-nonwoven" and insert therefor --embossed nonwoven--.

At column 3, line 50, delete "yams" and insert therefor --yarns--.

At column 3, line 62, delete "and-are" and insert therefor --and are--.

At column 4, line 2, delete "Size" and insert therefor --size--.

At column 4, line 23, delete "shuts" and insert therefor --to shute--.

At column 4, line 45, insert --,-- after the word "product".

Signed and Sealed this

Sixteenth Day of July, 1996

*Attest:*

Bruce Lehman

BRUCE LEHMAN

*Attesting Officer*

*Commissioner of Patents and Trademarks*